US010704499B2

(12) United States Patent
Burak et al.

(10) Patent No.: US 10,704,499 B2
(45) Date of Patent: Jul. 7, 2020

(54) METHOD FOR OPERATING A DEVICE FOR INJECTING WATER INTO AN INTERNAL COMBUSTION ENGINE

(71) Applicant: Robert Bosch GmbH, Stuttgart (DE)

(72) Inventors: Ingmar Burak, Stuttgart (DE); Peter Schenk, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/567,803

(22) PCT Filed: Apr. 13, 2016

(86) PCT No.: PCT/EP2016/058099
§ 371 (c)(1),
(2) Date: Oct. 19, 2017

(87) PCT Pub. No.: WO2016/177544
PCT Pub. Date: Nov. 10, 2016

(65) Prior Publication Data

US 2018/0112632 A1 Apr. 26, 2018

(30) Foreign Application Priority Data

May 7, 2015 (DE) ..... 10 2015 208 509

(51) Int. Cl.
*F02M 25/00* (2006.01)
*F02D 41/00* (2006.01)
(Continued)

(52) U.S. Cl.
CPC ..... *F02M 25/0227* (2013.01); *F02D 41/0025* (2013.01); *F02M 25/028* (2013.01); *F02M 25/035* (2013.01)

(58) Field of Classification Search
CPC ..... F02M 25/0227; F02M 25/028; F02M 25/035; F02D 41/0025
See application file for complete search history.

(56) References Cited

U.S. PATENT DOCUMENTS 9,273,581 B2 * 3/2016 Van Vuuren ..... F01N 3/208
2014/0325961 A1 * 11/2014 Yokota ..... F01N 3/208 60/274

FOREIGN PATENT DOCUMENTS

DE 102012220943 A1 6/2013
DE 102012206979 A1 10/2013
(Continued)

OTHER PUBLICATIONS

International Search Report dated Jul. 14, 2016, of the corresponding International Application PCT/EP2016/058099 filed Apr. 13, 2016.

*Primary Examiner* — Syed O Hasan
(74) *Attorney, Agent, or Firm* — Norton Rose Fulbright US LLP; Gerard Messina

(57) ABSTRACT

A method for operating a device for injecting water into an internal combustion engine, the device including a water tank for storing water, a pump for conveying the water, the pump being connected to the water tank via a first line, and the pump being operable in a conveying mode and in a back-suction mode, a drive for driving the pump, at least one water injector, which is configured to inject water into an air-conducting line of the internal combustion engine, the water injector being connected to the pump via a second line, the at least one water injector being opened during the operation of the pump in the back-suction mode, in which the water is conveyed in the direction of the water tank, so that air flows into the second line.

14 Claims, 2 Drawing Sheets

(51) Int. Cl.

| | |
|---|---|
| ***F02M 25/022*** | (2006.01) |
| ***F02M 25/035*** | (2006.01) |
| ***F02M 25/028*** | (2006.01) |

(56) References Cited

FOREIGN PATENT DOCUMENTS

| | | | | |
|---|---|---|---|---|
| DE | 102012207907 | A1 | | 11/2013 |
| DE | 102013204474 | A1 | | 9/2014 |
| DE | 102014219497 | A1 | | 4/2015 |
| EP | 2778381 | | * | 9/2014 |
| EP | 2778381 | A2 | | 9/2014 |
| EP | 2918813 | A1 | | 9/2015 |

* cited by examiner

FIG. 1
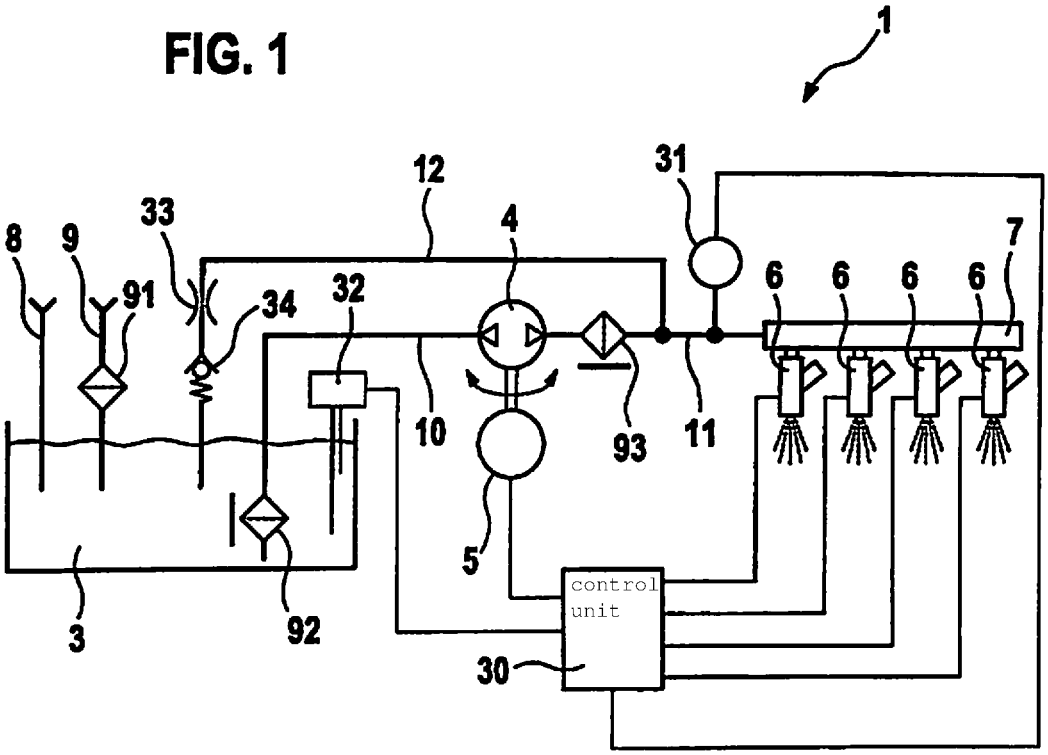
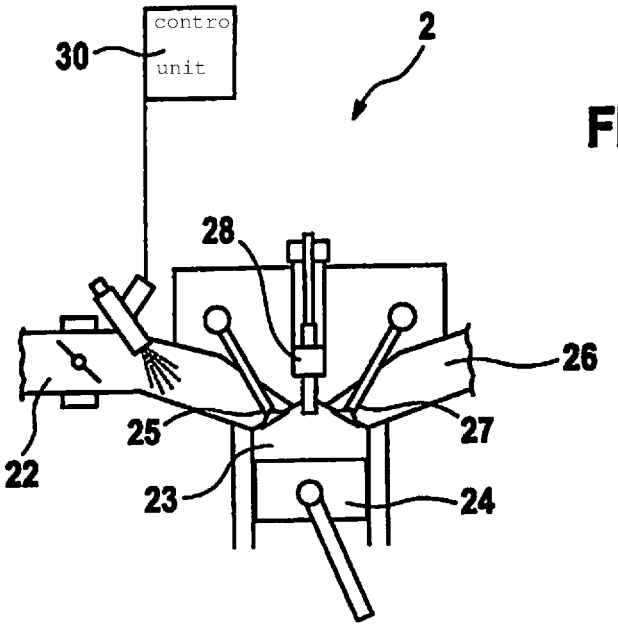
FIG. 2

METHOD FOR OPERATING A DEVICE FOR INJECTING WATER INTO AN INTERNAL COMBUSTION ENGINE

FIELD

The present invention relates to a method for operating a device for injecting water into an internal combustion engine, in particular, a gasoline engine.

BACKGROUND INFORMATION

Due to increasing demands for reduced carbon dioxide emissions, internal combustion engines are increasingly optimized with respect to fuel consumption. However, known internal combustion engines may not be optimally operated in operating points having high load with respect to consumption, since the operation is limited due to a knocking tendency and high exhaust gas temperatures. One potential measure for reducing the knocking tendency is a retarding of the ignition, however, this increases the fuel consumption for the same performance. To reduce the exhaust gas temperatures, the mixture is enriched, i.e., the ratio of air to fuel is shifted to values of $\lambda<1$, as a result of which the fuel consumption also increases.

One alternative option for reducing the knocking tendency and for lowering the exhaust gas temperatures is the injection of water into the internal combustion engine, either directly into the combustion chamber or into the intake tract of the internal combustion engine. Devices for injecting water into an internal combustion engine are described, for example, in German Patent Application No. DE 10 2012 207 907 A1.

SUMMARY

A particular challenge in the case of a device for injecting water is the risk of icing or of freezing of the water-conducting components due to the 0° C. freezing point of water, in particular, when the device for injecting water is inactive. Appropriate measures must be taken to avoid damage to the individual components and, therefore, to the entire device for injecting water during operation of the vehicle below the freezing point of water.

An object of the present invention is to provide a measure for a device for injecting water into an internal combustion engine, in which the icing or the freezing of the water-conducting components and, therefore, the risk of damage to the device for injecting water is minimized or avoided.

One option would be the addition of agents, for example, an antifreeze agent to the water in order to lower the freezing point of the water as much as possible. However, these agents would influence the combustion process in the engine as well as the chemical composition of the exhaust gas, as a result of which an after-treatment of the exhaust gas would be necessary to comply with the exhaust gas limiting values.

In accordance with the present invention, the object may be achieved by providing a method in which the at least one water injector is opened during operation of the pump in the back-suction mode, in which the water is conveyed back in the direction of the water tank, so that air flows into the second line. In this way, the water is suctioned from the second line and from the at least one water injector back into the water tank. A minimal water residue remains in the second line and in the at least one water injector which, when it freezes, is unable to damage the water line and the water-conducting components.

Since it is provided according to the present invention that air flows via the opened water injector into the second line during the operation of the pump in the back-suction mode, the back-suction of the water is simplified, since the formation of a negative pressure in the second line and in the water injection device is avoided. The avoidance of a negative pressure in the water injection device makes the back-suction particularly efficient. Within a few seconds, the water may be suctioned back out of the second line.

The device for injecting water into an internal combustion engine includes a water tank for storing water, a pump for conveying the water, the pump being connected to the water tank via a first line, a drive for driving the pump and at least one water injector, which is configured to inject water into an air-conducting line of the internal combustion engine, the water injector being connected to the pump via a second line.

The pump may be operated in two conveying directions: conveying mode and back-suction mode. In the conveying mode, the pump conveys water from the water tank in the direction of the at least one water injector. In the back-suction mode, the water is conveyed in the opposite direction from the water injector in the direction of the water tank. The drive for driving the pump drives the pump according to the desired conveying direction. The drive is preferably an electric drive such as, for example, an electric motor.

The at least one water injector has a closed state and an opened state. In the closed state of the at least one water injector, neither air nor water may flow through the water injector. In the opened state of the at least one water injector, water or air may flow through the water injector, depending on the operating mode of the pump. During the operation of the pump in the conveying mode, water is injected into, for example, an air-conducting line of an internal combustion engine via the opened water injector. During the operation of the pump in the back-suction mode, air flows, for example, from an air-conducting line of an internal combustion engine into the second line of the water injection device via the opened water injector.

The device for injecting water may optionally also have multiple water injectors, which are connected to one another and to the pump via a distributor or a rail. The device for injecting water is connected via the water injector or the water injectors to an internal combustion engine. All water injectors are advantageously opened during the operation of the pump in the back-suction mode, so that air may flow into the device for injecting water.

Additional advantageous embodiments are described herein.

The device for injecting water may advantageously include a control unit, which controls the operation of the pump and/or controls the water injector. The same control unit advantageously also controls the operation of the internal combustion engine. Alternatively, it is also conceivable that the control unit for controlling the components of the device for injecting water and a control unit for controlling the internal combustion engine are connected to one another and exchange information, for example, on the operating state of the internal combustion engine and on the operating state of the device for injecting water.

The control unit of the device for injecting water preferably controls the operating mode, conveying mode or back-suction mode of the pump. It may also be provided that the control unit also controls the starting point in time, the duration and/or the sequence of the back-suction mode of the pump. "Sequence" within the scope of the present invention means the chronological sequence and/or the speed of the pump used and, with that, the associated conveying capacity of the pump. For example, the speed of the pump and, with that, also the associated conveying capacity of the pump may be varied as a function of time.

The sequence of the back-suction mode may also be controlled, for example, in a model-based manner. In this case, a chronological sequence for the speed of the pump and a duration of the operation of the pump in the back-suction mode is predetermined as a function of the volume of the device for injecting water to be emptied and of the conveying capacity of the pump and is stored in the control unit, so that the control unit controls the sequence of the back-suction mode of the pump based on the model stored in the control unit. It may also be provided that multiple models for the sequence of the back-suction mode are stored in the control unit and the control unit controls the operation of the pump in the back-suction mode based on the different models as a function of the respective situation.

On the whole, it has proven advantageous for the back-suction mode of the pump to start after the internal combustion engine is switched off, in particular, immediately after the internal combustion engine is switched off. The operation of the pump is started preferably with the change of the operating state of the internal combustion engine in the control unit from "drive" to "control devices-overrun," the control unit being able to distinguish between the various operating states "drive" and "control devices-overrun" of the internal combustion engine.

In one advantageous specific embodiment, it is provided that the duration of the back-suction mode corresponds at least to a period of time required for back-suctioning a volume of water that extends from the pump to and including the water injector. This ensures that a sufficient amount of water is suctioned back from the water injector and from the second line. The period of time is calculated based on the volume of water to be back-suctioned and on the utilized conveying capacity of the pump. Potential factors that prolong the period of time such as, for example, the back-suctioning against a negative pressure building in the second line or, for example, the back-suctioning of a volume of air-water, are not incorporated in the computation.

One particularly advantageous specific embodiment provides that after termination of the back-suction mode, at least 75% of the water, which was in the second line and in the water injector before the start of the back-suction mode, has been suctioned back. A maximum of 25% of the original water remains in the second line and in the water injector after the end of the operation of the pump in the back-suction mode. Tests by the applicant have shown that this amount of water in the frozen state generally does not damage the components. To make particularly certain, at least 85% of the water is preferably suctioned back. The end of the back-suction mode is marked by the switching off of the pump and the closing of the water injector.

The control unit preferably controls the point in time and/or the duration of time of an opening of the water injector. The water injector may, for example, be opened simultaneously with the start of the operation of the pump in the back-suction mode. "Simultaneously" within the scope of this application means a time span of +/−50 ms in relation to the start of the operation of the pump in the back-suction mode.

Additional tests by the applicant have shown that it is advantageous if the water injector is initially opened with a time delay relative to the start of the operation of the pump in the back-suction mode. In this way, the water over-pressure in the second line and in the water injector may be reduced only by the back-suction of the pump and, preferably, a slight negative pressure may be built up before the water injector is opened and air subsequently flows into the second line. The time-delayed opening of the water injector prevents a portion of the water from inadvertently flowing, for example, into the air inlet port of the internal combustion engine via the opened water injector due to the water over-pressure prevailing in the second line and in the water injector. With the internal combustion engine switched off and with low outside temperatures, the water in the air inlet port could freeze and damage the air inlet port.

Thus, it may also be provided, alternatively to the simultaneous opening of the water injector, that the water injector is opened with a time delay relative to the start of the operation of the pump in the back-suction mode. The water injector is opened, for example, at least 100 ms or, preferably, at least 200 ms later than the start of the operation of the pump in the back-suction mode.

In another alternative design, the device includes a pressure sensor, which in the second line measures the pressure of the water in the line and the water injector is opened during operation of the pump in the back-suction mode only when the water pressure in the second line drops below a limiting value. This limiting value for the pressure is preferably below the air pressure prevailing in the air inlet port. The limiting value for the pressure may, for example, be the same as the ambient pressure in the case of a switched-off internal combustion engine.

The internal combustion engine includes a combustion chamber, in which fuel and air arrive separately from one another in the combustion chamber via multiple inlet valves. After combustion, the air-fuel mixture flows out of the combustion chamber again via an outlet valve. The air arrives at the air inlet valve via an inlet port, a so-called intake manifold. The water injector of the device for injecting water is preferably situated at the air inlet valve, preferably close to the air inlet valve, so that the water is injected into the air-conducting inlet port and arrives, together with the air, in the combustion chamber. By situating the water injector at the fresh air-conducting inlet port, it is ensured that only air and no air having additional gas components or particles forming during the combustion process arrive in the device for injecting water when the water injector opens during the operation of the pump in the back-suction mode. The additional gases forming during the combustion process could damage the components of the device for injecting water over time or the components would have to be designed to be correspondingly corrosion-resistant with respect to the additional gases forming in the combustion process. The particles forming during the combustion could clog and therefore damage components of the device for injecting water.

BRIEF DESCRIPTION OF THE DRAWINGS

FIG. 1 shows an example of a device for injecting water into an internal combustion engine.

FIG. 2 shows an example of a positioning of a water injector on an internal combustion engine.

DETAILED DESCRIPTION OF EXAMPLE EMBODIMENTS

Figure 3:
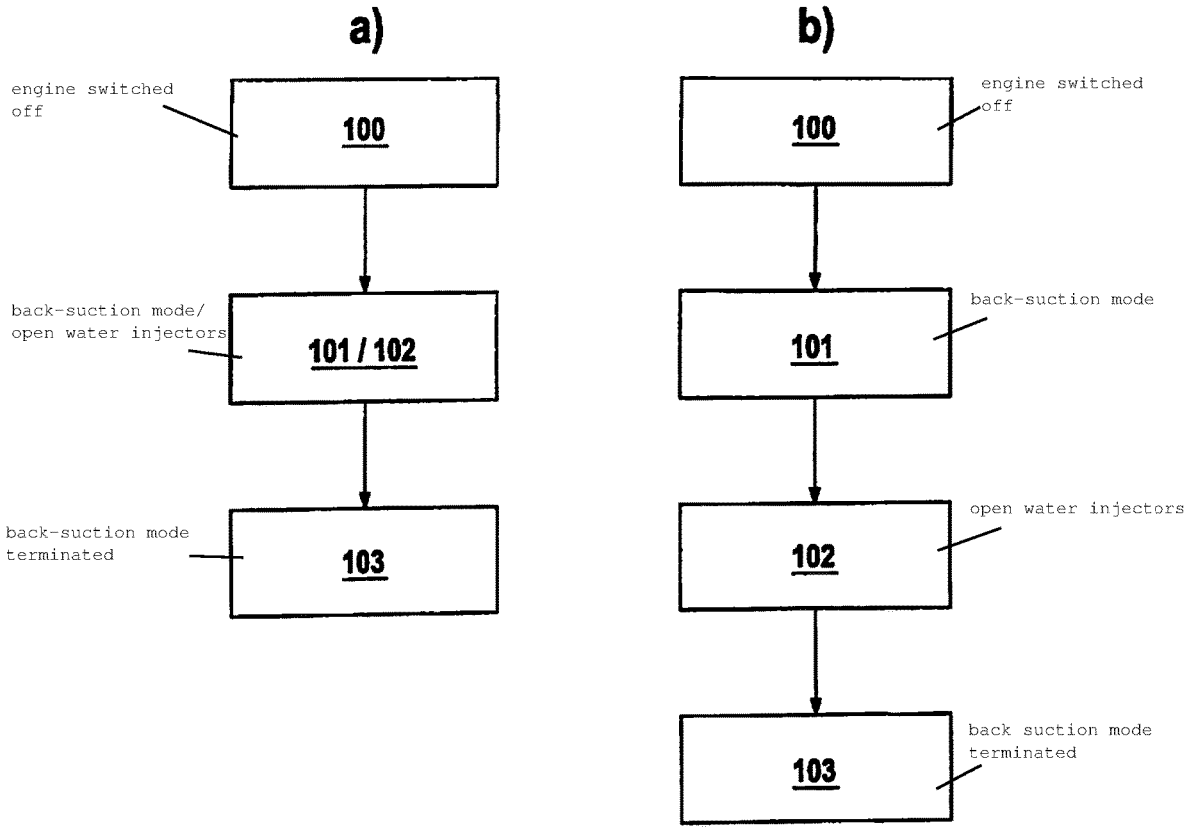
FIG. 3 shows two possible sequences of the method according to the present invention.

A device 1 for injecting water and a detail of an internal combustion engine 2 are depicted by way of example in FIG. 1 and FIG. 2.

The device 1 for injecting water includes a pump 4 and an electric drive 5 for driving the pump 4. A water tank 3 is also provided, which is connected to pump 4 via a first line 10. A second line 11 connects pump 4 to at least one water injector 6. As depicted here, a plurality of water injectors 6 may be connected to one another and to pump 4 via a distributor 7 or a rail.

To inject water into an air inlet port 22 or the intake manifold of internal combustion engine 2, water is fed from water tank 3 through pump 4 into water injector 6. The water in water tank 3 is, for example, a condensate from an air conditioning unit not shown here, the condensate being fed via an inflow line 8 to water tank 3. Alternatively or in addition to the condensate from the air conditioning unit, water tank 3 may be filled preferably with deionized water from the outside via a refill line 9. A screen 91 may be optionally provided in refill line 9. Furthermore, a prefilter 92 is situated in first line 10 and a fine filter 93 is situated in second line 11, in order to filter potentially present foreign bodies or dirt particles from the water. Prefilter 92 and/or fine filter 93 may optionally be designed to be heatable.

A sensor 32 may also be situated in or on water tank 3, which measures the fill level of the water in water tank 3 and/or the temperature of the water in water tank 3, and which forwards the result to a control unit 30 for monitoring and controlling the device 1 for injecting water.

Control unit 30 also controls pump 4 and its operating mode, i.e., the conveying direction, the conveying capacity and the duration of the respective operating modes of pump 4. Pump 4 may be operated in two opposite conveying directions. In the so-called conveying mode, pump 4 conveys water from water tank 3 to water injector 6. In the back-suction mode, pump 4 conveys or suctions the water from water injector 6 back into water tank 3. By selecting the appropriate speed of pump 4, it is possible to adjust the desired conveying capacity of pump 4.

To regulate the water pressure in second line 11, a pressure sensor 31 and/or a pressure regulator in the form of an aperture 33 may be situated in a return flow line 12 in device 1. Return flow line 12 connects second line 11 to water tank 3. Situated in return flow line 12 is a check valve 34, which prevents pump 4 from suctioning water via the return flow line 12 from water tank 3 into second line 11 during the operation of pump 4 in the back-suction mode.

Control unit 30 regulates the desired pressure in second line 11 by a combination of pressure sensor 31 with a speed variation of pump 4. The pressure in distributor 7 or in water injector 6 is set preferably in the range of 3-10 bar. This has the advantage that water covering the wall of the air inlet port 22 is minimized or eliminated when water is injected into air inlet port 22 of internal combustion engine 2. As a result, all of the injected water enters the combustion chamber 23.

Internal combustion engine 2 schematically depicted in FIG. 2 includes a plurality of valves. Internal combustion engine 2 includes one combustion chamber 23 per cylinder, in which a piston 24 is moveable back and forth. Internal combustion engine 2 also includes two inlet valves 25 per cylinder, each having one inlet port 22, via which air is fed to combustion chamber 23. An exhaust gas is discharged via an exhaust pipe 26. For this purpose, an inlet valve 25 is situated on inlet port 22 and an outlet valve 27 is situated on outlet port 26. A fuel injector 28 is also situated on combustion chamber 23.

A water injector 6 is situated on air inlet port 22 or on the intake manifold, which injects water in the direction of inlet valve 25 of internal combustion engine 2 while controlled by control unit 30.

Control unit 30 controls the operation of pump 4 and of water injector 6. Control unit 30 also controls the operation of internal combustion engine 2. Control unit 30 receives information via various sensors such as, for example, pressure sensor 31, velocity sensor, temperature sensor 32, etc. about the surroundings and about the operating states of the individual components of device 1 for injecting water and internal combustion engine 2, and based on this information is able to control and/or regulate the operation of device 1 for injecting water as well as internal combustion engine 2. Control unit 30 may distinguish between various operating states of internal combustion engine 2: "drive" and "control devices-overrun."

Two possible embodiments of the method according to the present invention for operating a device 1 for injecting water are schematically depicted in FIG. 3. In a first method step 100, internal combustion engine 1 is switched off, i.e. the operating state of internal combustion engine 1 changes from "drive" to "control devices-overrun." Control unit 30 in device 1 for injecting water correspondingly starts the method according to the present invention. Due to the change of the operating mode of internal combustion engine 1, control unit 30 also initiates a change of the operation in pump 4 from conveying mode to back-suction mode. The conveying mode of pump 4 is reversed, so that the water from water injector 6 or the water injectors is suctioned back in the direction of water tank 3. This corresponds to second method step 101 in FIG. 3. The start of the back-suction mode of pump 4 typically takes place immediately with the change of the operating mode in internal combustion engine 2.

In the method sequence according to FIG. 3 *a*), water injector 6 or the water injectors is/are opened simultaneously with the start of the back-suction mode of pump 4, so that air from air inlet port 22 of internal combustion engine 2 is able to flow into device 1 for injecting water, "simultaneously" meaning that the two actions are initiated within a time span of 50 ms.

In an alternative method sequence according to FIG. 3*b*), water injector 6 or the water injectors is/are opened with a time delay relative to the start of the back-suction mode of pump 4 in a further method step 102. The time delay may be a previously determined fixed period of time of, for example, 100 ms or 200 ms. Alternatively, the precise value of the time delay may be selected as a function of the back-suction capacity of pump 4 and of the volume to be emptied in second line 11 and of water injector 6 or the water injectors.

Alternatively, it is also possible that the time delay is varied situationally. Control unit 30 monitors the water pressure in second line 11 via pressure sensor 31 situated in second line 11. Control unit 30 opens water injector 6 or the water injectors only if the pressure measured by pressure sensor 31 drops below a limiting value. This limiting value for the pressure is preferably equal to the air pressure prevailing in air inlet port 22 or is below the air pressure in air inlet port 22. This prevents a portion of the water from flowing from water injector 6 or from second line 11 into air inlet port 22 of internal combustion engine 2 and potentially freezing solid there when internal combustion engine 2 is stopped and with low outside temperatures.

In last method step 103, the back-suction mode of pump 4 is terminated by switching off the pump and water injector 6 is closed again.

The duration and sequence of the operation of pump 4 in the back-suction mode are controlled by control unit 30. In the process, the duration and/or the sequence of the back-suction mode may be model-based or situationally controlled. In the model-based sequences, the duration of the operation of pump 4 in the back-suction mode is established as a function of the volume of the components to be emptied, of the adjusted conveying capacity of pump 4, as well as of the activation strategy of water injectors 6. The duration in this case corresponds to at least a period of time, which is required with the established conveying capacity of pump 4 for back-suctioning the volume of water extending from pump 4 up to water injectors 6.

The conveying capacity of pump 4 is proportional to the speed of pump 4. Also proportional to the speed of pump 4 are the noises caused by pump 4. It is conceivable, for example, that as long as additional noise-generating components, for example, a cooler or a fan for the internal combustion engine, are still active, the pump is operated at a higher speed and that with the reduction of the number of additional noise-generating components, the speed of pump 4 and, therefore, the noises generated by pump 4, are reduced. In principle, it is conceivable that the speed of pump 4 remains constant during the back-suction phase. Alternatively, the speed of the pump may also be gradually and/or continuously reduced.

In the case of a situationally controlled sequence of the operation of pump 4 in the back-suction mode, control unit 30 regulates the speed of pump 4 as a function of the operating state of additional components of the internal combustion engine such as, for example, as a function of the entire background noise of the internal combustion engine and/or of additional parameters of the surroundings such as, for example, the outside temperature.

The control unit may, for example, operate the pump in the back-suction mode until at least 75% of the water is suctioned back. The residual water located in second line 11 and water injectors 6 may be calculated in the control unit on the basis of the pressure information of pressure sensor 31 situated in second line 11 and on the basis of the information stored in the control unit regarding the volume to be emptied. The maximum amount of water located in second line 11 and in water injector 6 or the water injectors at the start of the operation of pump 4 in the back-suction mode provides the initial value for the computation. A maximum of 25% of the original water remains behind after the end of the operation of pump 4 in the back-suction mode. Tests by the applicant have shown that this amount of water in the frozen state generally does not damage the components. Preferably at least 85% of the water is suctioned back.

Water tank 3 and the components situated in or on water tank 3 must be designed to be freeze-resistant, since naturally these components of device 1 for injecting water remain filled even after the end of the operation of pump 4 in the back-suction mode. In addition, the water may not be suctioned off from aperture 33, check valve 34 and return flow valve 12, so that these components are also designed to be freeze-resistant.

What is claimed is:

1. A method for operating a device for injecting water into an internal combustion engine, the device including a water tank for storing water, a pump for conveying the water, the pump being connected to the water tank via a first line, and the pump being operable in a conveying mode and in a back-suction mode, a drive for driving the pump, at least one water injector, which is configured to inject water into an air-conducting line of the internal combustion engine, the water injector being connected to the pump via a second line, the method comprising:

opening the at least one water injector during the operation of the pump in the back-suction mode, in which the water is conveyed in a direction of the water tank, so that air flows into the second line, wherein the back-suction mode of the pump is started after the internal combustion engine is switched off.

2. The method as recited in claim 1, wherein the device for injecting water includes a control unit, the control unit controlling the operation of the pump and the at least one water injector.

3. The method as recited in claim 2, wherein the control unit controls, model-based, at least one of: a starting point in time, a duration, and a sequence of the back-suction mode of the pump.

4. The method as recited in claim 3, wherein the duration of the back-suction mode corresponds at least to a period of time, which is required for back-suctioning a volume of water, which extends from the pump to and including the water injector.

5. The method as recited in claim 1, wherein at least 75% of the water, which was in the second line and in the at least one water injector before the start of the back-suction mode, is suctioned back after termination of the back-suction mode.

6. The method as recited in claim 2, wherein the control unit controls at least one of: (i) a point in time, and (ii) a period of time, of an opening of the at least one water injector.

7. The method as recited in claim 1, wherein the at least one water injector is opened simultaneously with a start of the operation of the pump in the back-suction mode.

8. The method as recited in claim 1, wherein the at least one water injector is opened with a time delay relative to a start of the operation of the pump in the back-suction mode.

9. The method as recited in claim 1, wherein the at least one water injector is opened at least 100 ms later than a start of the operation of the pump in the back-suction mode.

10. The method as recited in claim 1, wherein the device includes a pressure sensor, which in the second line measures a pressure of the water in the line and the at least one water injector not being opened during the operation of the pump in the back-suction mode until the water pressure in the second line drops below a limiting value.

11. The method as recited in claim 1, wherein in the back-suction mode, air flows into the second line from the air-conducting line of the internal combustion engine.

12. The method as recited in claim 1, wherein the second line is directly connected to the pump.

13. The method as recited in claim 8, wherein the time delay is a function of a back-suction capacity of the pump and a volume of water to be emptied in the second line.

14. The method as recited in claim 10, wherein the limiting value corresponds to a pressure that is no more than an air pressure at an air inlet port of the internal combustion engine.

* * * * *